US010506359B2

(12) United States Patent
Esslinger

(10) Patent No.: US 10,506,359 B2
(45) Date of Patent: Dec. 10, 2019

(54) INNOVATIVE SOUND SYSTEM

(75) Inventor: Hartmut Esslinger, Los Gatos, CA (US)

(73) Assignee: Naxos Finance S.A., Luxembourg (LU)

( * ) Notice: Subject to any disclaimer, the term of this patent is extended or adjusted under 35 U.S.C. 154(b) by 263 days.

(21) Appl. No.: 14/005,028

(22) PCT Filed: Jan. 6, 2012

(86) PCT No.: PCT/US2012/020455

§ 371 (c)(1),
(2), (4) Date: Jun. 25, 2015

(87) PCT Pub. No.: WO2012/094576

PCT Pub. Date: Jul. 12, 2012

(65) Prior Publication Data

US 2015/0312692 A1 Oct. 29, 2015

Related U.S. Application Data

(60) Provisional application No. 61/430,333, filed on Jan. 6, 2011.

(51) Int. Cl.

| | |
|---|---|
| ***H04S 5/00*** | (2006.01) |
| ***H04R 1/40*** | (2006.01) |
| ***H04R 5/02*** | (2006.01) |

(52) U.S. Cl.

CPC ..... *H04S 5/005* (2013.01); *H04R 1/403* (2013.01); *H04R 5/02* (2013.01); *H04R 2201/403* (2013.01); *H04R 2205/021* (2013.01); *H04R 2205/022* (2013.01)

(58) Field of Classification Search

None

See application file for complete search history.

(56) References Cited

U.S. PATENT DOCUMENTS

| | | | | |
|---|---|---|---|---|
| 4,030,563 | A * | 6/1977 | Zinna | H04R 1/403 181/147 |
| 4,182,931 | A * | 1/1980 | Kenner | H04R 1/227 181/144 |
| 4,387,826 | A | 7/1989 | Schupbach | |
| 6,072,879 | A | 6/2000 | Ouchi et al. | |
| 8,379,892 | B1 * | 2/2013 | Gu | H04R 1/403 381/304 |

(Continued)

FOREIGN PATENT DOCUMENTS

| | | |
|---|---|---|
| DE | 3142462 | 5/1982 |
| EP | 0248172 | 12/1987 |

(Continued)

OTHER PUBLICATIONS

International Search Report for Application No. PCT/US2012/020455 dated Apr. 24, 2012.

*Primary Examiner* — Curtis A Kuntz
*Assistant Examiner* — Kenny H Truong
(74) *Attorney, Agent, or Firm* — Workman Nydegger

(57) ABSTRACT

A sound system comprising: a body (4) with several substantially vertical panels; at least two sound emitting elements (10, 12) mounted on the body; and an electronic circuit providing drive signals to the sound emitting elements; wherein said at least two sound emitting elements (10, 12) are mounted on said substantially vertical panels and are oriented along two different directions (26).

16 Claims, 2 Drawing Sheets

(56) References Cited

U.S. PATENT DOCUMENTS

| | | | | |
|---|---|---|---|---|
| 2001/0036286 | A1* | 11/2001 | Layton | H04R 5/02 381/304 |
| 2004/0234093 | A1 | 11/2004 | Kawakami | |
| 2005/0013454 | A1* | 1/2005 | Huang | H04R 1/403 381/182 |
| 2005/0089182 | A1* | 4/2005 | Troughton | H04R 1/26 381/307 |
| 2006/0078129 | A1* | 4/2006 | Nakamichi | H04S 7/303 381/18 |
| 2008/0285762 | A1 | 11/2008 | Iwamoto et al. | |
| 2009/0110204 | A1* | 4/2009 | Walsh | G10L 19/16 381/17 |
| 2009/0279732 | A1* | 11/2009 | Maurer | H04R 1/025 381/387 |
| 2009/0316938 | A1* | 12/2009 | Matsumoto | H04R 3/12 381/300 |
| 2010/0166212 | A1* | 7/2010 | Ishibashi | H04R 1/403 381/92 |
| 2012/0206651 | A1* | 8/2012 | Minoda | H04R 1/403 348/552 |

FOREIGN PATENT DOCUMENTS

| | | |
|---|---|---|
| EP | 0762801 | 3/1997 |
| WO | WO 2007/127781 | 11/2007 |

* cited by examiner

Fig. 1
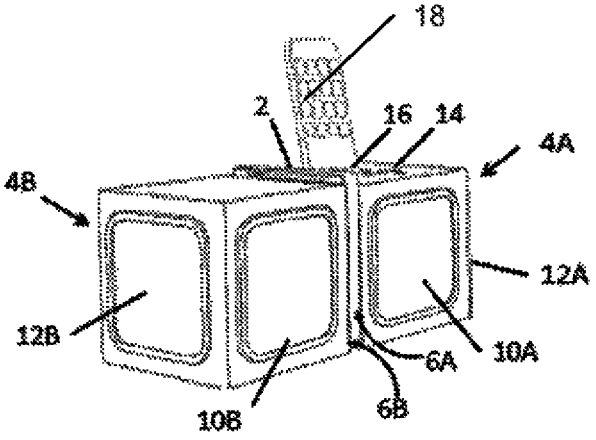
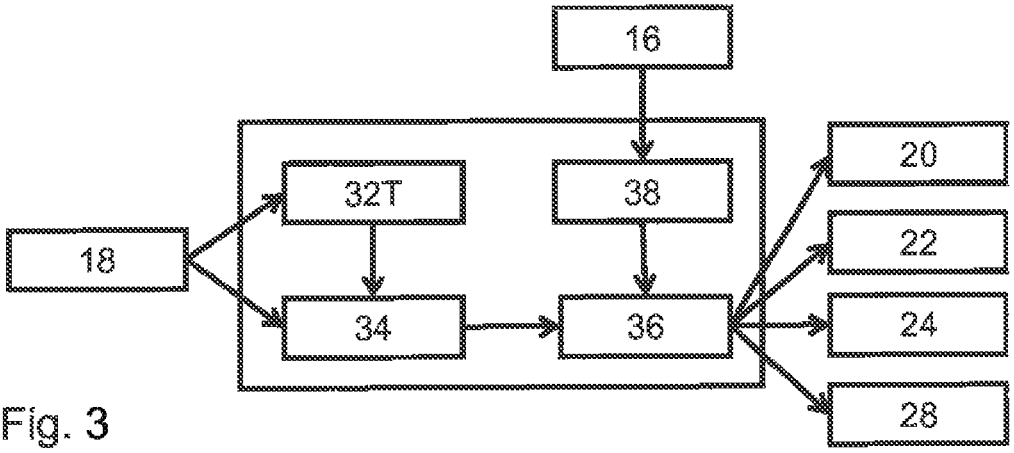
Fig. 3

INNOVATIVE SOUND SYSTEM

CROSS-REFERENCE TO RELATED APPLICATIONS

This application is a US nationalization of PCT Application No. PCT/US2012/020455, filed Jan. 6, 2012, which claims the benefit of U.S. Provisional Application No. 61/430,333, filed Jan. 6, 2011.

DESCRIPTION

The present invention concerns an innovative sound system.

In order to provide listeners a more enjoyable experience sound systems have been designed to provide a so called "surround effect." Surround effects are intended to provide listeners the impression that sound is coming from multiple directions at once. In most cases, such sound systems with surround effect capability comprise several sound emitting elements placed at different locations in order to create a restricted central area where sound can be received from all sound emitting elements at once.

However, such sound systems present several draw backs. Those systems are inherently complex to set up as sound emitting elements must be placed at several locations. In addition the area receiving the sound from all sound emitting elements at once is relatively narrow.

The present invention provides a compact and simple alternative to such existing sound systems. More precisely, the invention relates to a sound system comprising a body with several substantially vertical panels, at least two sound emitting elements mounted on the body and an electronic circuit providing drive signals to the sound emitting elements. In the invention, said at least two sound emitting elements are mounted on said substantially vertical panels and are oriented along two different directions.

In one embodiment, a sound emitting element is mounted on each substantially vertical panel.

Advantageously, sound emitting elements are placed evenly around the periphery of the body of the sound system.

In one embodiment, the sound emitting elements are mounted on the body of the sound system symmetrically with regard to a vertical axis of the body.

In one embodiment, the sound system further comprises at least one woofer mounted on a bottom panel of the body.

Advantageously, the sound system further comprises stands protruding from the bottom panel of the body.

In one embodiment, each said substantially vertical panel is tilted away from the vertical axis to a maximum of fifteen (15) degrees.

Advantageously, several sound emitting elements are mounted on the body along orthogonal axis with regard to one another.

In one embodiment, the electronic circuit is configured for providing several sound emitting elements with different drive signals.

In one embodiment, the electronic circuit is configured for providing a different sound signal to each sound emitting element.

Advantageously, the electronic circuit is configured for generating said different drive signals based on the specific configuration of the sound emitting elements of the sound system.

The invention is described in more details with reference to the attached figures wherein:

FIG. 1, is a perspective view of an embodiment of the invention;

FIG. 3, is a functional representation of the electronic circuit of the embodiment of FIGS. 2A and 2B.

Figure 2A:
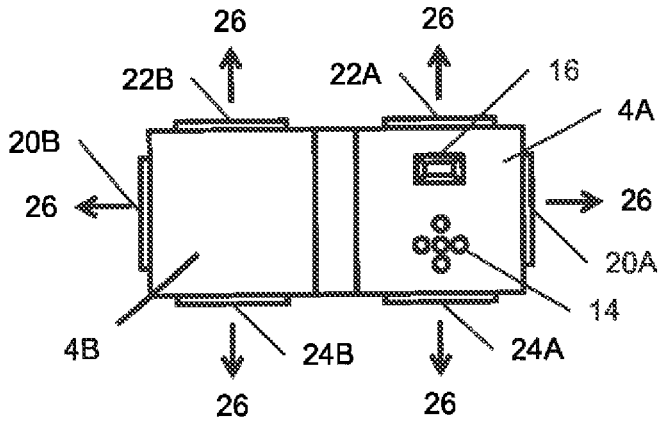
FIG. 2A, is a top view of another embodiment.

With reference to FIG. 1 a first embodiment of the invention is described. The sound system represented on FIG. 1 comprises three parts, namely a central part 2 and two side blocks 4A and 4B. The side blocks 4A and 4B are commonly referred to as side blocks 4. Similarly, other elements featured on both side blocks are individually referenced using a numerical reference and the letters "A" and "B" and are commonly referenced using only the numerical reference.

Side blocks 4 have a general shape of cubes with inner panels 6A and 6B connected to the central part 2. Each side block 4 comprises sound emitting elements on at least two substantially vertical lateral panels other than the inner panel 6A or 6B. In the example described with reference to FIG. 1, each side block 4 comprises a sound emitting element 10 mounted on a front lateral panel 8 and on another sound emitting element 12 mounted on a lateral panel opposite to the inner panel 6.

In the example, the sound system also comprises a control panel 14 providing a user interface for operating the sound system. In the example, this control panel comprises several buttons mounted on the upper panel of the side block 4A. Alternatively, the control panel comprises a screen, a touch screen, buttons or any combination thereof.

Furthermore, the sound system of the invention comprises a connection element 16. In the example of FIG. 1, the connection element is a docking station for an external music source 18, this docking station being integrated in an upper panel of side block 4A.

Inside the sound system and not represented on FIG. 1, the sound system comprises an electronic circuit adapted for processing sound information received from the external music source 18 via the connection element 16 and adapted for driving the sound emitting elements 10 and 12.

Of course, the electronic circuit also comprises supporting circuits such as connectors, power supply and the like which are classical and will not be described here.

The embodiment of FIG. 1 allows the sound system to emit sound from a single location in several directions at once. The sound will be reflected by the environment creating multiple echoes and therefore a more ambient sound experience for listeners regardless of their specific position with regard to the sound emitting elements.

Also, the sound system of the invention compensates the natural filtering of high frequency resulting from the relatively small size of the sound emitting elements that present relatively small chambers and relatively small magnets by using multiple sound emitting elements and a corresponding filtering of the sound signals in the electronic circuit.

The sound system of the invention is further configured for handling so called "multichannel" configurations. Multichannel refers to a configuration in which different sound emitting elements receive different drive signals and output different sounds. Examples of such multichannel systems frequently have a right and left channel or a front and back channel or more complex configurations such as the so called "5.1" or the like.

In the embodiment described, the sound system of the invention is adapted to provide different drive signals corresponding to different channels to different sound emitting elements. In one embodiment every sound emitting element receives a drive signal corresponding to a different channel.

In another embodiment illustrated with reference to FIGS. 2A and 2B, each side block 4 comprises three sound emitting elements 20, 22 and 24 positioned on each substantially vertical lateral panel of the side blocks 4 except the inner panels 6 facing toward the central part 2. As a consequence, sound emitting elements are spread evenly around the periphery of the sound system.

The sound emitting elements are mounted on each side block so that the sound emitting elements are placed symmetrically with regard to a vertical axis of the sound system such as the central vertical axis of the central part 2.

In the example, the sound emitting elements of each block are generally oriented orthogonally one with another. Each side block 4 has a general shape of a cube and the sound emitting elements are mounted on adjacent panels of each side block along orthogonal axis.

As a consequence, in this embodiment, the sound system of the invention emits sound in every direction as represented by the arrows 26 in FIG. 2A and in turn this provides the user with a sound surround effect regardless of its position in the environment using multiple echo paths and reflections.

Figure 2B:
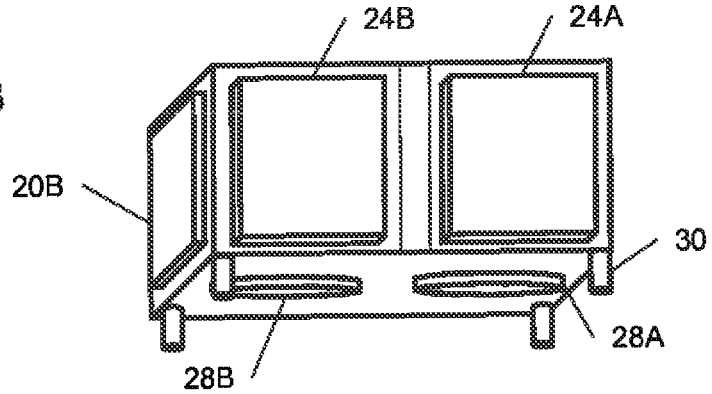
FIG. 2B, is a perspective bottom view of the embodiment of FIG. 2A.

In addition, as illustrated in FIG. 2B, the sound system also comprises at least one so called "woofer" speakers 28 mounted on one or more of the bottom panels of the sound system so that the woofers are facing downward. In the example, one woofer 28 is placed on each bottom panel of the side blocks 4A and 4B. In such embodiment, the sound system comprises at least one stand 29 protruding from the bottom panel in order to create a space between the woofer and a surface supporting the sound system.

Similarly to the embodiment described with reference to FIG. 1, the sound system comprises an electronic circuit providing drive signals to the sound emitting elements. A function block of the electronic circuit used in this embodiment is represented on FIG. 3.

In the example described, the electronic circuit comprises a single processing chip such as a digital signal processor (DSP) 30, comprising several modules or programs.

The DSP 30 comprises an input module 32 for processing the sound information received from the external music source 18 via the connection element 16. The input module 32 is adapted for processing inputs from various types of external music sources, various codec and the like. Advantageously, the DSP 30 comprise a detection module 34 adapted to automatically detect the type of input by analyzing electrical parameters thereof, or by a trial-and-error process. Alternatively, the control panel 14 allows a user to indicate the nature of the input in order for the DSP 30 to select a program for processing the corresponding sound information.

Accordingly, the same DSP 30 is used to process different types of inputs such as digital or analog, stereo or mono, .mp3 or other.

The DSP 30 also comprises an output module 36 for driving the sound emitting elements. The output module 36 comprises processing algorithms to transform any received sound signal into multichannel drive signals corresponding to the configuration of the sound system. For example the processing unit receives a stereo sound signal and outputs drive signals corresponding to a specific multichannel configuration matching the specific positions of the sound emitting elements.

In the example described, the output module 36 is set for a 6.1 multichannel configuration so that a different drive signal is provided to each sound emitting element 20, 22 and 24, while another drive signal is provided to the woofers 28.

Advantageously, the DSP 30 comprises an adjustment module 38 providing the output module 36 with parameters representatives of the mechanical configuration and environment of the sound system such as angles between and/or distances between sound emitting elements and wall or the like. Those parameters are taken into consideration in the algorithms of the DSP 30 to adjust the drive signals provided to the sound emitting elements.

For example, the adjustment module is connected to the user interface 14 to allow a selection between several preset positions in the environment such as against a wall, in the middle of a room or the like in order to adjust the processing algorithms to the environment of the sound system.

Many other embodiments can be encompassed without departing from the invention.

While the side block embodiments illustrated in the Figures have a general cubical shape, in other embodiments, other shapes may be utilized, including but not limited to other regular solid shapes, parallelepiped shapes, cylindrical shapes, pyramidal shapes, and conical shapes.

In another embodiment, the sound emitting elements are mounted on inclined panels, each panel being tided or inclined to form an angle of maximum fifteen (15) degrees with the vertical axis. In one example of such embodiment, the sound system has an overall pyramidal shape. Experiments show that an angle of more than fifteen (15) degrees with the vertical axis results in a substantive diminution of the surround sound effect.

Advantageously, each sound emitting element can be individually or in group enabled or disabled by using the control panel or individual switches or the like. This allows further adjusting of the sound system to the environment by disabling speakers to close to a wall or facing toward a sensitive area.

In one embodiment, each sound emitting element comprises an assembly of speakers, loudspeakers and/or woofers. In one example, each sound emitting element comprises one speaker and one woofer. In another example, each sound emitting element comprises two speakers adjusted for different frequency ranges and one woofer.

In another configuration, each side block comprises at least two kinds of sound emitting elements different from one another. For example, sound emitting elements on the edges of the sound system comprise woofers while the other sound emitting elements comprise one or several speakers.

Advantageously, the sound emitting elements are mounted on the side blocks in order to optimize the inside space of each side block. When positioning the sound emitting elements in each side block, the driving mechanisms of the sound emitting elements might mechanically interfere with one another inside the side block. In one embodiment the sound emitting elements of a same side block are spaced vertically in the inside volume of the side block. For example, the sound emitting element facing one direction is placed at the very bottom of the side block while the sound emitting element facing another direction is placed at the very top of the side block. Accordingly, the sound emitting elements are overlapping on the vertical axis.

Such configuration allows the use of deeper and therefore more powerful sound emitting elements while maintaining a reduced overall volume for the sound system.

Advantageously, the side blocks are hollow to provide a resonance space and reduce the weight of the sound system.

In one embodiment, the electronic circuit is entirely integrated in the central part. Alternatively, the electronic circuit is integrated in one of the panels of a side block.

In one embodiment, the electronic circuit comprises a connector for being connected to a computer or the like and uploading new version of the software in the memory.

In one embodiment, the sound system comprises a rechargeable battery. For example, the rechargeable battery is located in the central element. This embodiment allows the sound system to be carried and used without: being connected to a power source.

In one embodiment, the connection element is integrated in the sound system such as represented on FIGS. 1 and 2. Alternatively, the connection element is a cable attached to the central part or a movable docking station that can be placed on the side blocks or anywhere in the vicinity.

In one embodiment, at least one of the side blocks is mobile and is adapted to be separated from the central part. For example, the central part is electrically connected to the mobile side block by a cable mounted around a spring coil and mechanically coupled using for example, vertical grooves. Such mechanical coupling allows the mobile slide block to be separated from the central part by a vertical sliding motion. This embodiment allows a user to customize the position of the sound emitting elements.

In another embodiment, the electronic circuit comprises several chips associated with memories comprising software with code instructions for processing the sound information received from an external music source and via the connection element and for driving the sound emitting elements.

What is claimed is:

1. A sound emitting device comprising:

a plurality of sound emitting elements;

a body comprising:

a central part;

a plurality of substantially vertical panels comprising at least four substantially vertical panels;

each substantially vertical panel being arranged symmetrically to another substantially vertical panel; and each substantially vertical panel having a sound emitting element mounted thereon; and an electronic circuit providing drive signals to the sound emitting elements, wherein the drive signals comprise surround sound signals, such that each of the drive signals is different from the other drive signals and each differs in phase and/or frequency;

wherein said electronic circuit is entirely integrated in said central part or in one of said panels;

wherein said electronic circuit comprises a digital signal processor;

wherein said digital signal processor is configured to drive said sound emitting elements and is configured to transform any received sound signal into multichannel drive signals corresponding to a configuration of said sound emitting device;

wherein said digital signal processor is configured to enable or disable each of the plurality of sound emitting elements individually or in groups, wherein said sound emitting elements are oriented along at least two different directions and are arranged to emit sound in at least four different directions.

2. The sound emitting device of claim 1;

wherein the sound emitting elements are mounted on the body symmetrically with regard to a vertical axis of the body.

3. The sound emitting device of claim 1, further comprising:

at least one woofer mounted on a bottom panel of the body.

4. The sound emitting device of claim 1, further comprising:

stands protruding from the bottom panel of the body.

5. The sound emitting device of claim 1;

wherein each said substantially vertical panel is tilted away from the vertical axis to a maximum of fifteen degrees.

6. The sound emitting device of claim 1;

wherein several sound emitting elements are mounted on the body along an orthogonal axis with regard to one another.

7. The sound emitting device of claim 1;

wherein the electronic circuit is configured for providing a different sound signal to each sound emitting element.

8. The sound emitting device of claim 1;

wherein the electronic circuit is configured for generating said different drive signals based on the specific configuration of the sound emitting elements of the sound system.

9. The sound emitting device of claim 1;

wherein each sound emitting element is mounted to one of the vertical panels to emit sound in a horizontal direction along a horizontal plane that intersects with the vertical panels; and wherein the sound emitting elements are arranged around the periphery of the body so as to emit sound in all directions of the horizontal plane.

10. The sound emitting device of claim 9;

wherein the sound emitting elements are mounted on each vertical panel so that the sound emitting elements are placed symmetrically with regard to a vertical axis of the sound system.

11. The sound emitting device of claim 1, wherein the drive signals comprise at least four different drive signals.

12. The sound emitting device of claim 11, wherein the plurality of sound emitting elements comprise at least four different sound emitting elements, each of the at least four different sound emitting elements being arranged to emit sound in a different direction.

13. The sound emitting device of claim 12, wherein each of the at least four different sound emitting elements receives a different one of the at least four different drive signals.

14. The sound emitting device of claim 1, wherein the electronic circuit providing drive signals to the sound emitting elements is configured to receive a stereo signal and output drive signals corresponding to a specific multichannel configuration matching specific positions of the sound emitting elements.

15. The sound emitting device of claim 1, wherein the electronic circuit providing drive signals to the sound emitting elements is configured to adjust the drive signals based on the mechanical configuration and current environment of the sound emitting device.

16. The sound emitting device of claim 1, wherein the sound emitting elements are mounted on inclined panels, each panel being inclined to form a maximum angle of 15 degrees with respect to the vertical axis.

* * * * *